US005639708A

United States Patent [19]

Golemo et al.

[11] Patent Number: 5,639,708

[45] Date of Patent: Jun. 17, 1997

[54] PROVIDING A UV CURABLE PROTECTION STRIP ON A BUSINESS FORM

[75] Inventors: John C. Golemo, Nacogdoches, Tex.; Kenneth Riggs, Lake Forest, Ill.

[73] Assignee: Moore Business Forms, Inc., Grand Island, N.Y.

[21] Appl. No.: 802,622

[22] Filed: Dec. 5, 1991

[51] Int. Cl.[6] ..... B41M 5/128

[52] U.S. Cl. ..... 503/205; 503/206; 503/226

[58] Field of Search ..... 503/205, 226, 503/206

[56] References Cited

U.S. PATENT DOCUMENTS

| | | | |
|---|---|---|---|
| 3,293,650 | 12/1966 | Buros | 346/1 |
| 3,485,168 | 12/1969 | Martinson | 101/426 |
| 4,291,102 | 9/1981 | Tsukahara et al. | 503/205 |
| 4,327,127 | 4/1982 | Dapp et al. | 427/146 |
| 4,327,128 | 4/1982 | Thurlow | 427/153 |
| 4,631,203 | 12/1986 | Schaefer et al. | 427/145 |
| 4,775,597 | 10/1988 | Birkmeyer et al. | 428/481 |
| 4,891,240 | 1/1990 | Ward et al. | 427/11 |
| 5,153,168 | 10/1992 | Uhlemayr et al. | 503/206 |

FOREIGN PATENT DOCUMENTS

| | | | |
|---|---|---|---|
| 0085346 | 1/1983 | European Pat. Off. | 503/205 |
| 2354013 | 4/1975 | Germany | 503/205 |

OTHER PUBLICATIONS

Patent Abstracts of Japan, vol. 010, No. 385, 24 Dec. 1986 & JP–A–671 175 076, 6 Aug. 1986.

Aetek International, Inc. UV Curing Equipment, 1990.

Brewer Design Inc. "A" Series Wide Web UV Curing Systems, 1990.

Fusion Ultraviolet Curing Systems Flyer SB591, 1990.

Zeller+Gmelin "High Quality Inks for the Graphics Industry", flyer, 1990.

Sun Chemical General Printing Ink "UV & EB Curing" flyer, Jul., 1990.

*Primary Examiner*—Pamela R. Schwartz

*Attorney, Agent, or Firm*—Nixon & Vanderhye P.C.

[57] ABSTRACT

Business forms, particularly financial instruments such as checks, money orders, bank drafts, etc., are constructed with CF and CB, or self-imaging, sheets. MICR characters may be printed on the sheets without subsequent smearing by applying a UV curable ink to a CF or self-imaging sheet so as to block the CF or self-imaging material at the selected portion to which the ink is applied, thereby rendering it incapable of functioning as a CF or self-imaging element. The ink is applied to a moving web in a continuous manner prior to printing to form a continuous strip of ink, which moves past a UV radiation source so that it is quickly cured and does not adversely affect high speed production. The ink may also be applied to a CB, CF, or self-imaging sheet as a security feature, selectively blocking the transmission of confidential indicia at the selected portion of the sheet with which it is associated.

10 Claims, 2 Drawing Sheets

Fig. 1
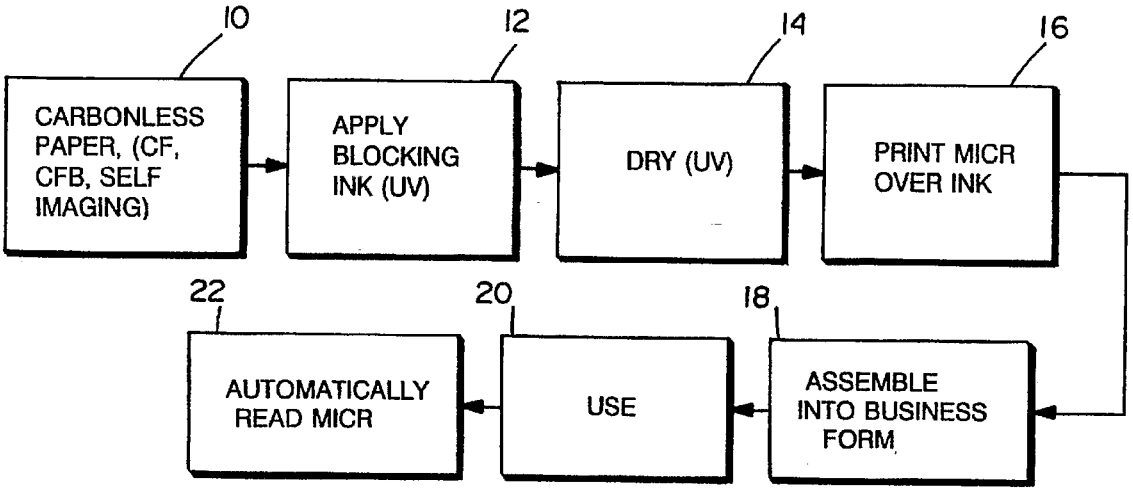
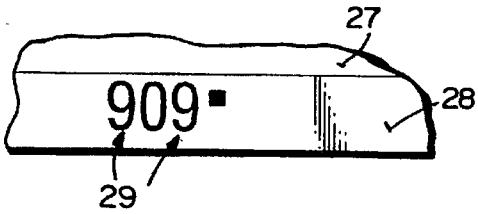
Fig. 3
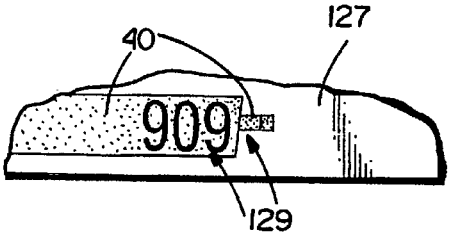
Fig. 4 (PRIOR ART)

PROVIDING A UV CURABLE PROTECTION STRIP ON A BUSINESS FORM

BACKGROUND AND SUMMARY OF THE INVENTION

There are many financial documents and multiple part business forms that are desirably printed on MCP (carbonless) paper. That has not been practical for many financial documents in the past since it is necessary for MICR (magnetic ink code readable) characters to be printed on internal sheets of the form. If the MICR characters are printed on CF, CB, or self-imaging sheets, they will smear when subsequently being processed, thereby resulting in inaccuracies in reading the numbers, and thus making the forms useless. It is because of this problem that conventional multi-part financial document business forms requiring MICR characters utilize carbon interleaving, despite the advantages of MCP over carbon interleaving.

According to the invention a method and product are provided which overcome the problems associated with smearing of MICR characters on MCP paper, allowing MCP paper to be used for multiple part financial documents requiring MICR characters. Also, the invention provides a simple method and a product that are utilizable in multiple part business forms to allow confidential information to be printed on some parts of the form, but not selected other parts of the form, thereby enhancing the versatility of multi-part forms.

The basic feature of the present invention is the application of a blocking fluent material to selected portion of a CF, CB, or self-imaging substrate. The blocking fluent material has the effect of masking the substrate so as to deactivate the image transferring capacity of the CF, CB, or self-imaging material of the substrate. Preferably the fluent material is an ultraviolet radiation curable white ink. The ink is preferably applied to a moving web of substrate material, and is then passed through a UV dryer on a continuous basis so that business forms can be produced according to the invention at high speed. After curing the ink, the substrate may be printed with MICR characters, such as with an Autographics transfer ribbon on a collator, directly over the dried/cured ink. The characters so printed will not smear during subsequent handling, and can be effectively read by MICR equipment. Also, the ink may be applied to intermediate sheets of a business form at portions thereof where it is not desirable for confidential information to be imaged, so that a security feature is also provided.

According to one aspect of the present invention, a method of treating a CF, CB, or self-imaging substrate is provided comprising the steps of: (a) Applying a blocking fluent material to only a selected portion of a moving CF, CB, or self-imaging substrate. And, (b) drying or curing the blocking fluent material so that the image transferring capacity of the selected portion of the substrate is deactivated so that it no longer functions as a CF, CB, or self-imaging element. Preferably the substrate moves in a first direction during the practice of both steps (a) and (b), and step (a) is practiced by applying the fluent material as a continuous strip extending in the first direction. Preferably there is also the further step of printing MICR characters on a part of the continuous strip, and preferably step (a) is practiced by applying a UV curable white ink as the blocking fluent material, and step (b) is practiced by moving the substrate past a UV radiation source, and applying UV radiation to the UV curable ink.

The method may also comprise the further alternate steps of forming the substrate into CF, self-imaging, or CB sheets, and assembling those sheets with other CF, CB, and/or self-imaging sheets to form a business form with the selected portion of the substrate being positioned within the business form so that confidential information applied to the business form in an area overlying the blocking material will not be transferred to a sheet cooperating with the blocking material.

According to another aspect of the present invention a business form is provided which comprises: At least first and second sheets, at least one of the sheets being a self-imaging sheet, or a CF sheet while another is a CB sheet. And, a blocking material disposed on only a selected portion of at least one of the self-imaging or the CB and CF sheets, the blocking material rendering the selected portion incapable of functioning as a self-imaging, CF, or CB element.

According to another aspect of the present invention, there also may be provided a financial instrument comprising: At least one CF sheet and one CB sheet, or at least one self-imaging sheet. MICR characters disposed on a selected portion of the CF sheet, or the self-imaging sheet. And, means preventing smearing of the MICR characters when fed through automatic equipment for acting on the CF or self-imaging sheet.

It is the primary object of the present invention to provide for the high speed production of business forms of MCP paper that can have MICR characters printed therein, and which can have security features. This and other objects of the invention will become clear from an inspection of the detailed description of the invention, and from the appended claims.

BRIEF DESCRIPTION OF THE DRAWINGS

FIG. 1 is a schematic view illustrating exemplary steps for the production and utilization of business forms according to the method of the present invention;

FIGS. 3 and 4 are detail views showing MICR characters provided on MCP paper according to the invention (FIG. 3), or if according to the prior art (FIG. 4)

DETAILED DESCRIPTION OF THE DRAWINGS

Figure 2:
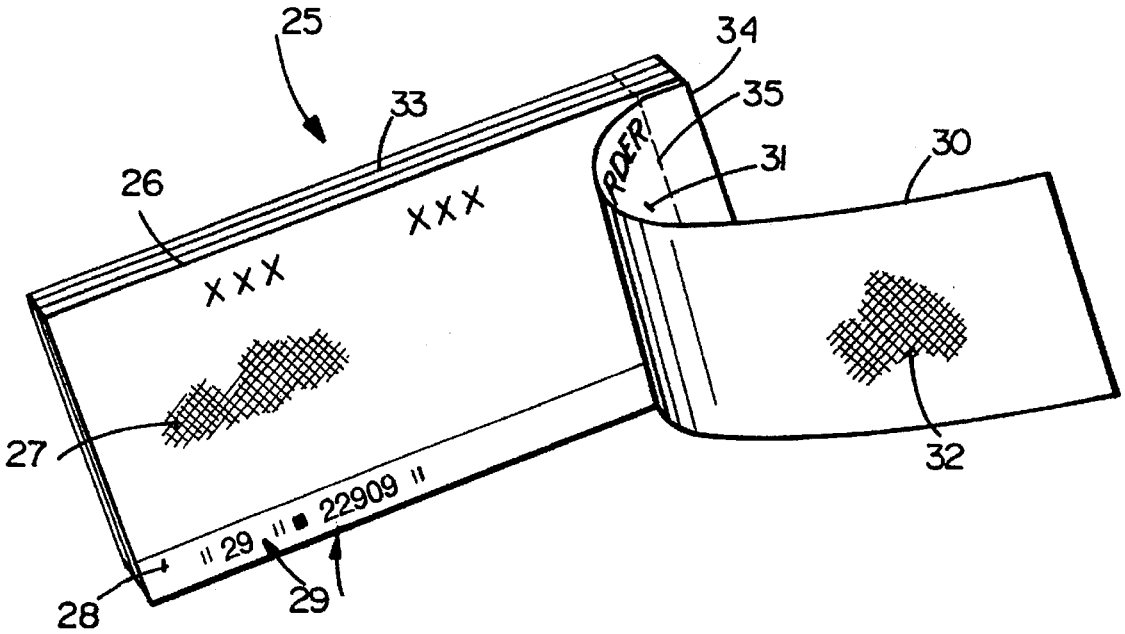
FIG. 2 is a top perspective view of an exemplary business form according to the present invention.

The invention makes possible the utilization of carbonless (MCP) paper in multiple part business forms, such as financial documents like money orders, checks, drafts, certificates, and the like, that utilize MICR characters, or security features.

The method according to the present invention, is schematically illustrated in FIG. 1. Carbonless paper, such as CF, CB, self-imaging, or the like is fed by conventional feeding equipment associated with printers to a station 12 where a blocking fluent material is applied to a selected portion of the continuously moving substrate of CF, CB, or self-imaging paper. At the station 12 it is preferred that a UV curable ink be applied in a continuous strip on the moving substrate, and then the substrate passed to a drying station 14. The ink is a means to preventing smearing of subsequently applied MICR characters.

The UV curable ink according to the present invention preferably has a predominant color that is the same as the predominant color of the substrate, such as white, although other colors may also be utilized. For example the inks may be those supplied by Sun Chemical known as UV curable inks, and which are cured by ultraviolet light energy which converts the ink or coating material to a solid dry film. Alternatively the ink may be a UV curable ink from Zeller+Gmelin of America Inc. of Richmond, Va., and sold under the trademark "Uvarolid". The equipment for drying, at station 14, may comprise a conventional commercially available UV lamp, such as those supplied by Fusion UV Curing Systems Corporation of Rockville, Md. (marketed under U.S. Pat. Nos. 4,503,086 and 4,208,587), or by Wallace Knight, or Brewer Design Inc. of Chino, Calif., or Aetek International, Inc. of Plainfield, Ill.

Where multiple colors are provided, there may be a series of stages 12 before the drying stage 14, or the stages 12 may be alternated with the stages 14. Ultimately, after drying of the UV curable ink (which can be effected quickly, that is at conventional web travelling speeds), MICR characters may be printed over the ink, as indicated at stage 16 in FIG. 1, as with an Autographics transfer ribbon on a collator.

If the substrates are not already in the form of cut sheets during ink application and printing, they may be cut into sheets by conventional equipment and then assembled into financial document business forms at stage 18, e.g. assembled into money orders, bank drafts, certificates, and the like. The business forms are then utilized in the normal course of business as indicated at stage 20, impact printing to provide variable information being provided on the faces of the business forms and automatically transferred to the underlying parts by the MCP paper. Ultimately, when a part of the business form having the MICR characters on it is utilized, it is automatically read at stage 22 (e.g. at a bank), the reading taking place, according to the invention, without smearing.

An exemplary business form produced according to the invention is illustrated generally by reference numeral 25 in FIG. 2. The form 25 has multiple parts including a sheet 26 of MCP paper, such as a CF sheet as indicated by reference numeral 27. Alternatively, instead of CF, the structure 27 maybe a self-imaging coating. Self-imaging, CF, and CB coatings are described in U.S. Pat. No. 5,024,374, the disclosure of which is hereby incorporated by reference herein.

The blocking fluent material, preferably a radiation curable ink in strip form, is illustrated at reference numeral 28 in FIG. 2. The MICR characters which are printed on the dried ink 28 are illustrated generally by reference numeral 29.

Overlying the sheet 26 of the business form 25 is a sheet 30 having a front face 31 to which variable information may be applied by an impact printer or handwriting. The variable data applied to the face 31 is transferred to the underlying sheets, such as the sheet 26, of the form 25 by the various CF, CB, and/or self-imaging coatings provided on the sheets. For example a CB layer 32 may be provided on the back of the sheet 30 which cooperates with the CF layer 27 to transfer material imaged on the surface 31 of the sheet 30. Alternatively CB layer 32 could be eliminated and the layer 27 made a self-imaging layer.

In the business form 25, other MCP sheets 33 also are usually provided. The edges of all of the sheets are aligned, and they are affixed together—as with staples, adhesive, or the like—at the edges 34. Perforations 35 are preferably provided in each sheet 30, 26, 33 (any number of additional carbonless sheets 33 may be provided, each preferably having a strip 28 thereon) to allow detachment from the form.

When the sheet 26 with the CF or self-imaging coating 27 thereon passes through conventional MICR reading equipment it is smeared, however it is not according to the invention. FIG. 3 illustrates the MICR characters 29 according to the invention, on the ink strip 28, after passage through automatic reading equipment. The configuration of MICR characters in FIG. 3 should be compared to what they would look like if printed directly on a CF or self-imaged coating 127 as illustrated in FIG. 4. All of the characters 129 in FIG. 4 are smeared, as illustrated by reference 40, allowing potential errors in reading or other adverse consequences.

Figure 5:
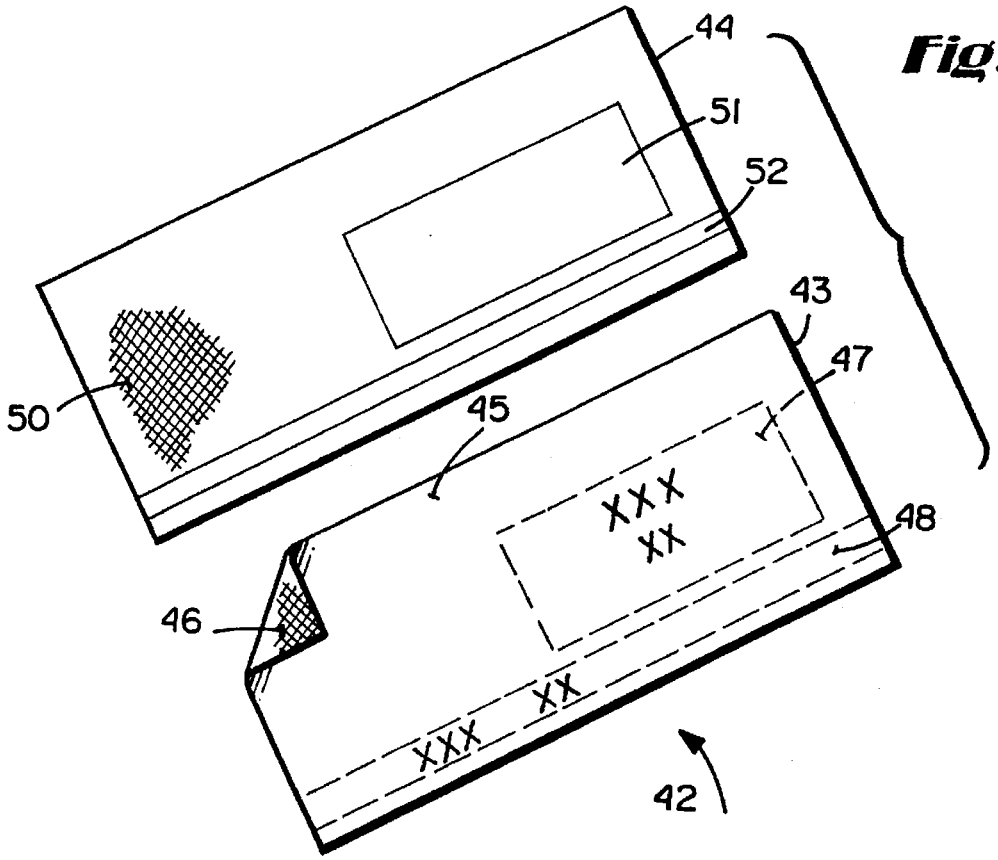
FIG. 5 is a top perspective view of top and second components of a multiple part business form having a security feature according to the invention.

Another exemplary financial instrument or like business form according to the present invention is illustrated generally by reference numeral 42 in FIG. 5. The business form 42 of FIG. 5 shows two sheets 43, 44 which have been detached from a common attachment along the right edge thereof. That is the right hand edges of the top sheet 43 and next sheet 44 of the business form have been detached along perforations.

The top sheet 43 of the business form 42 has a plain paper top face 45 on which variable information may be printed or written, and preferably has a MCP-CB layer 46 on the back surface thereof. One or more areas 47, 48 are provided in which confidential data may be printed or written.

In the utilization of the business form 42, it may be desirable to have the confidential data on the top sheet 43, but it may be undesirable on the next sheet 44, other things printed or written on other portions of the face 45 of the top sheet 43 may desirably be imaged by the CF (or self-imaging) layer 50 on the second sheet 44. For this purpose, fluent blocking material, such as UV curable ink, is provided at selected portions 51, 52 over the CF layer 50 on the second sheet 44. The portion 51 is in the form of a block, while the portion 52 is in the form of a strip, corresponding to the portions 47, 48 on the face 42 of the top sheet 43.

The portions 51, 52 of dried/cured ink provide a security feature, rendering the image transferring capacity of those portions 51, 52 of the substrate layer 50 deactivated so that it no longer functions as a CF or self-contained layer. Of course the business form 42 may have any number of parts which either include the security features provided by the portions 51, 52, or do not, depending upon whether that particular sheet is one that desirably has confidential data thereon considering its normal use.

While the invention has been herein shown and described in what is presently conceived as the most practical and preferred embodiment, it will be apparent to those of ordinary skill in the art that other modifications may be made within the scope of the invention. For example, other inks or coatings that are curable quickly, so as to accommodate the normal high speed processing of business forms, such as financial instrument business forms, may be provided instead of UV curable inks, such as EB inks and coatings. Thus the invention is to be accorded the broadest interpretation of the appended claims so as to encompass all equivalent products and processes.

What is claimed is:

1. A business form comprising:

at least first and second sheets, at least one of the sheet being a self-imaging sheet, or a CF sheet while another is a CB sheet;

a blocking material disposed on only a selected portion of said CF or self-imaging sheet, the blocking material rendering said selected portion incapable of functioning as a self-imaging or CF element; and MICR characters machine printed on said blocking material, so that the machine printed MICR characters will not smear when machine processed.

2. A business form as recited in claim 1 wherein said blocking material is ink.

3. A business form as recited in claim 2 wherein said blocking material is disposed as a continuous, elongated, constant width, strip along the length of said self-imaging or CF sheet.

4. A business form as recited in claim 2 wherein said blocking material is UV curable ink.

5. A business form as recited in claim 4 wherein said blocking material is disposed as a continuous, elongated, constant width, strip along the length of said self-imaging or CF sheet.

6. A business form as recited in claim 1 wherein said blocking material is disposed as a continuous, elongated, constant width, strip along the length of said self-imaging or CF sheet.

7. A financial instrument comprising:

at least one CF sheet and one CB sheet, or at least one self-imaging sheet;

MICR characters machine printed on a selected portion of said CF sheet, or said self-imaging sheet; and means preventing smearing of said MICR characters when fed through automatic equipment for acting on said CF or self-imaging sheet.

8. A financial instrument as recited in claim 7 wherein said means for preventing smearing comprises an ink between said CF or self-imaging sheet and said MICR characters.

9. A financial instrument as recited in claim 8 wherein said ink comprises a UV curable white ink.

10. A financial instrument as recited in claim 8 wherein said ink is disposed as a continuous, elongated, constant width strip along the length of said self-imaging or CF sheet.

* * * * *